United States Patent [19]

Bacon et al.

[11] 4,222,834

[45] Sep. 16, 1980

[54] SELECTIVELY TREATING AN ARTICLE

[75] Inventors: Duane E. Bacon; J. David Gattermeir, both of Lee's Summit; Bonnie J. Hrivnak, Kansas City, all of Mo.

[73] Assignee: Western Electric Company, Inc., New York, N.Y.

[21] Appl. No.: 45,895

[22] Filed: Jun. 6, 1979

[51] Int. Cl.[3] ..... C25F 3/16; C25F 7/00

[52] U.S. Cl. ..... 204/129.6; 204/224 R

[58] Field of Search ..... 204/129.65, 224 R, 129.6

[56] References Cited

U.S. PATENT DOCUMENTS

| | | | |
|---|---|---|---|
| 1,773,135 | 8/1930 | Flanzer | 204/224 R |
| 2,434,286 | 1/1948 | Pfann | 204/129.6 |
| 2,763,608 | 9/1956 | Pool | 204/129.6 |
| 3,361,662 | 1/1968 | Sutch | 204/224 R |
| 3,573,176 | 3/1971 | Laznovsky | 204/224 R |
| 3,657,097 | 4/1972 | Baldock | 204/224 R |

*Primary Examiner*—T. M. Tufariello

*Attorney, Agent, or Firm*—W. O. Schellin

[57] ABSTRACT

An edge surface (18) of an article (16) is treated in a fluid (52) with a minimum effect on other adjacent side surfaces of the article by contacting the edge surface to the surface of the fluid such that the fluid wets the side surfaces and forms a meniscus adjacent to each of the side surfaces. In the meniscus the fluid stagnates and quickly becomes an inactive barrier which shields the side surfaces of the article, while the edge surface of the article remains exposed for the duration of the treatment to the active bulk of the fluid.

9 Claims, 5 Drawing Figures

FIG.-3
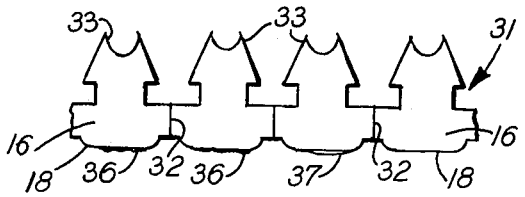
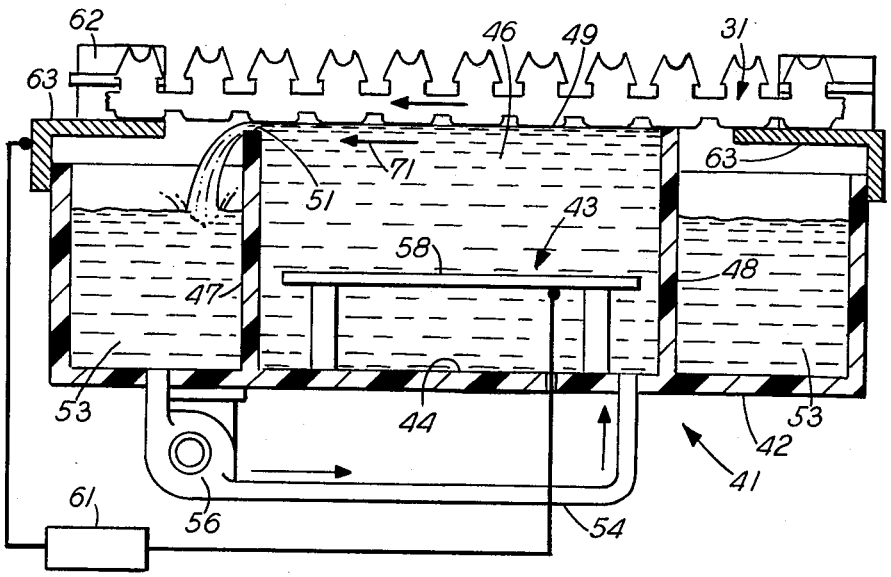
FIG.-4
FIG.-5
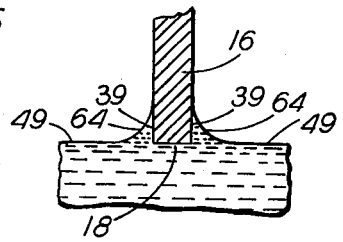

SELECTIVELY TREATING AN ARTICLE

TECHNICAL FIELD

This invention relates to selectively treating an article in a fluid and particularly to treating a face or edge surface of such article. More particularly, the invention relates to selectively etching an edge surface of an article, such as an electrical connector blade. In a described use of the invention a contact surface of such a connector blade is deburred and smoothed in preparation for a gold plating operation. The description of the invention in reference to the connector blade is for illustrative purposes only and is not to be interpreted as limiting to the scope of the invention.

BACKGROUND OF THE INVENTION

In the recent past, modular telephone connectors have become established in telephone systems. These connectors typically are used in interconnections between a telephone handset and a telephone body, and between a telephone and a telephone service wall outlet. To comply with a service standard, a modular connector plug typically must withstand at least one thousand insertions into a mating socket or jack without destructive wear on a low resistance gold layer on the contact surfaces of the plug and its respective jack.

It is known that the life span of a gold layer plated over a smooth surface of a base metal is greater than that of a similar gold layer plated over a relatively rougher base metal surface when both gold layers are subjected to similar frictional engagements with mating surfaces. A problem exists, however, in applying this knowledge in a useful and efficient manner to the manufacture of small articles, such as contact blades for the aforementioned modular telephone connectors.

When an electrolytic etching process, referred to as electropolishing, was used to smooth the contact edge of the blade, it was found that a sufficient electrolytic action to smooth the contact edge of the blade also attacked the already smooth sides of the blade to thin the blade and thereby to deform and weaken the blade. The electrolytic polishing action became especially detrimental when a strip of a plurality of such contact blades was moved through an electrolytic bath.

The above attempt to electropolish the contact blades involved a submersion of the articles to be treated into the electrolytic bath. In some special electrolytic treating processes, however, articles are only partially submersed into the electrolyte. For instance, in the manufacture of contact wires for diodes, crystal rectifiers and detectors, it is desirable to form a point on a wire. The point contacts and establishes a rectifying contact with a semiconductor or other crystal element. In forming the point, the submersed portion of the wire is uniformly attacked and electrolytically dissolved except near the surface of the electrolyte where the electrolytic action in a meniscus is known to decrease until it stops at the surface. It is adjacent the meniscus of the electrolyte, where the desired point on the wire forms.

This described concept has in the past been applied in a process involving inserting a metal blade partially into an electrolytic etching bath to form a tapered edge along the blade by dissolving the metal extending into the electrolytic bath. The process consequently permits tapering the metal blade near the surface of the bath. However, such a tapered edge is undesirable on the described connector blade in that such a tapered edge tends to laterally displace and jam against a mating wire contact. Also, a reduced contact area at the edge of a tapered cross section tends to increase the contact force per area and thereby increase the frictional wear on the contact.

SUMMARY OF THE INVENTION

We have now found that a treating action on an edge of an article can be enhanced to smooth the edge without forming a taper on the article by locating the edge at the surface of an electrolyte to permit the electrolyte to wet the edge of the article. The surface tension of the electrolyte forms a meniscus on both side surfaces of the article and the wetted portion of the article is located substantially within the formed meniscus.

According to the invention a method of treating an edge of an article includes positioning the edge of the article in contact with the surface of a wetting fluid, such that the surface tension of the fluid forms a meniscus along both major side surfaces of the article and above the surface of the fluid, whereby the portion of the article exposed to the fluid is located substantially within the formed meniscus.

Such a method for accomplishing a treatment of an edge of an article has been found to result in an enhanced action on the face of an edge of the article directed toward the bulk of the fluid. It appears that the surface tension and viscosity of the fluid cause the fluid in the meniscus to adhere to, and remain stagnant in relationship to the article. In contrast, the bulk of the fluid is not immobile in relationship to the article. Such relatively stagnant fluid appears to shield the side surfaces of the article from receiving any substantial amount of treating action. The edge surface of the article, however, faces the bulk of the fluid and has been found to be subjected to what appears to be an enhanced treating action.

Accordingly, in a particular embodiment of the invention, a method of electrolytically treating an edge of an article in an electrolytic bath includes positioning the article at the surface of the bath to expose the edge surface to the bath and form a meniscus at the surface of the bath between side surfaces of the article adjoining the edge surface and the bath, and establishing an electrolytic treating action between the article and the bath.

BRIEF DESCRIPTION OF THE DRAWING

Features and advantages of this invention will be better understood from the detailed description below when read in conjunction with the accompanying drawing, wherein:

FIG. 3 shows a plurality of the connector blades of the plug of FIG. 2, the blades being preferably treated while still interconnected in a unitary strip during an intermediate stage of their manufacture;

FIG. 4 is a longitudinal section taken through a typical apparatus for treating the strip of connector blades of FIG. 3 in accordance with the invention; and FIG. 5 is an enlarged partial end section through the apparatus of FIG. 4, showing a portion of one of the connector blades in relationship to the treating medium of the apparatus during the treatment process.

DETAILED DESCRIPTION

1. A Typical Product

Figure 1:
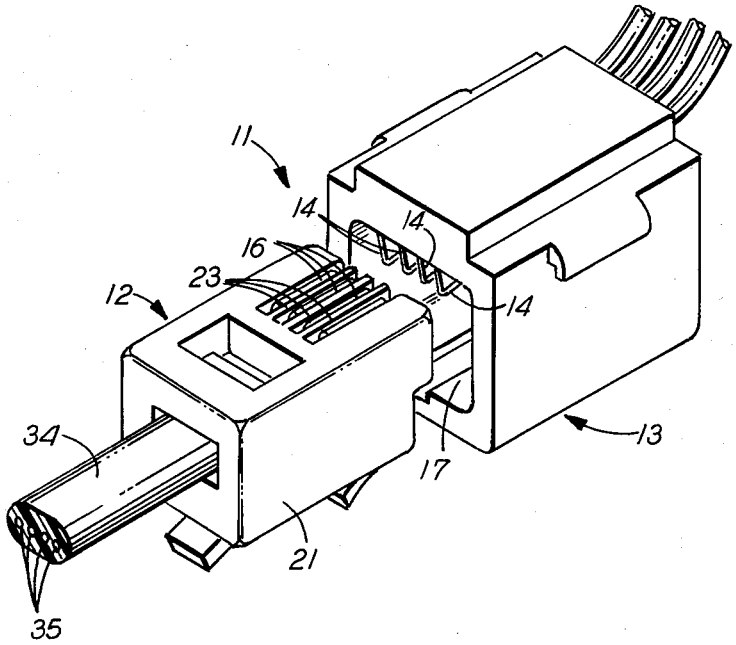
FIG. 1 is a pictorial representation of a modular telephone connector jack and of a corresponding plug as a typical example of an article to which the invention advantageously applies.

Referring now to FIG. 1, there is shown a modular telephone connector which is designated generally by the numeral 11. The connector 11 includes a connector plug 12 which mates with a corresponding jack 13. The depicted plug 12 and jack 13 are of a type which have become standard connector elements for connecting modular telephone terminal components. Typically the jack 13 is used as a terminal of fixed wiring installations on user's premises. Telephone cords of desk sets terminate in the mating plugs 12 to connect the desk sets to the fixed wiring. Similar jacks 13 are also installed in the telephone sets and in hand receivers to permit one of the known coiled type receiver cords to connect one of the hand receivers to a respective one of the telephone sets.

Electrical connections between the jack 13 and the plug 12 are made between typically four wire spring contacts 14 located in the jack 13 and four corresponding connector blades 16 located in the plug 12. The wire spring contacts 14 extend into a guide path 17 located in the jack 13. The guide path 17 slideably receives the plug 12. As the plug 12 is inserted into the guide path 17 the contacts 14 engage and become resiliently deflected by the corresponding connector blades 16. The resilient force exerted by the contacts 14 against mating edge surfaces 18 of the blades 16 establishes and maintains an electrical connection through the connector 11 and between respective circuits (not shown) which the connector links together.

To minimize contact resistance between the contacts 14 and the corresponding blades 16, the surfaces of the contacts 14 and the edge surfaces 18 of the blades 16 typically are gold plated. Specifications establish that the gold layer on these respective surfaces may not wear off for at least a predetermined number, e.g., one thousand, of insertions of the plug 12 into the jack 13. Since it has been found that the wear of gold on the mating surfaces is diminished on surfaces with relatively greater surface smoothness, a rather smooth surface finish of the gold plated edge surfaces 18 appears to be desirable.

Figure 2:
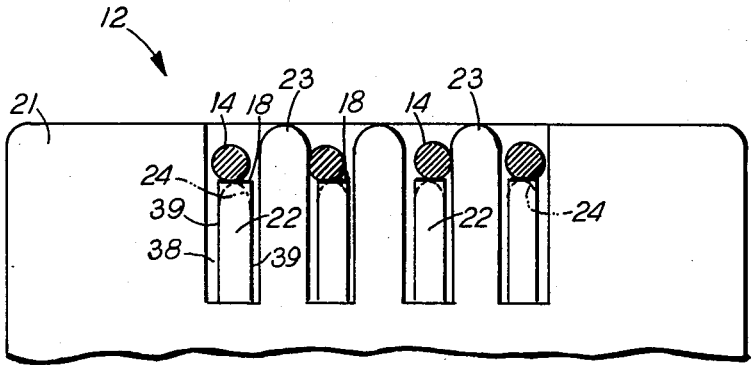
FIG. 2 is an enlarged end view of the connector plug showing a portion of the housing with a plurality of connector blades, and a cross section of a corresponding plurality of wire elements of the jack in one-to-one engagement with the connector blades of the plug.

FIG. 2 is an enlarged view of a portion of the jack 13 in contact with the corresponding plug 12. Wire spring contacts 14 are shown in engagement with corresponding ones of the connector blades 16 of the plug 12. The connector blades 16 are inserted in parallel with each other into, for example, an acrylic type plastic housing 21 which constitutes the main body of the plug 12. A portion 22 of each blade 16 including the edge surface 18 lies exposed from the housing 21. However, the housing 21 extends as insulating ridges 23 between adjacent blades 16. The ridges 23 function as guides for the contacts 14 when plug 12 is inserted into the jack to direct each contact 14 into engagement with its respective blade 16. Once the plug 12 has been inserted into the jack 13 the ridges prevent adjacent contacts 14 from touching each other in an electrical short circuit.

FIG. 3 shows a plurality of the connector blades 16 during an intermediate stage of their manufacture. Until inserted into the housing 21, the blades remain preferably, though not necessarily, laterally interconnected as a strip 31. The strip 31 of the blades 16 is typically formed in a conventional punch and die operation. Lines 32 indicate the locations at which the strip 31 becomes separated into the individual blades 16. Edges formed along the lines 32 during such separation are not critical in the electrical function of the blades and, therefore, need not be exposed to treating steps. Points 33 pierce the insulation of a telephone cable 34 during the assembly of the blades 16 into plug 12. The points 33 are desirably sharp and are gold plated to minimize any electrical resistance to a respective conductor 35 in the cable. The portions 22 and in particular surfaces 18 are, however, critical in establishing an electrical connection between the blades 16 and the corresponding contacts 14. Consequently, particular attention needs to be directed to adequately preparing the portions 22 for the important function to be performed thereby.

It has been found that the punch and die operations, which are conventionally used to form the strip 31, do not leave a sufficiently smooth surface finish on the edge surfaces 18 for them to serve as a base for the gold layer. Any surface roughness on one of the surfaces 18 tends to further the forming of discrete peaks of plated gold which quickly wear to expose the underlying base metal of the connector blade 16, such base metal being typically a copper alloy or a nickel coated copper alloy. The bared copper alloy, however, tends to oxidize and offer a higher electrical resistance than what might be acceptable to insure quality service of the equipment involved. The useful life of the connector 11 depends, therefore, on the existence of the gold on the contacts 14 and on the edge surfaces 18 of the blades 16.

2. General Considerations

In order to improve the useful life of the connector 11, surface defects, such as sharp edges or burrs 36 and other imperfections 37 (see FIG. 3) are to be removed from the edge surfaces 18 prior to subjecting the blades 16 to a plating process. By removing such surface defects from the surfaces 18 to the extent that they are no longer discernible under a 70 power magnification of the blades 16, the surfaces 18 are rendered sufficiently smooth for the ultimately plated gold layer to meet present lifetime specifications for the connector 11. Removing these defects by conventional electro-deburring processes has been found to have an adverse effect. These processes tend to thin the blades 16, as shown by phantom lines 24 in superposition on the blade portions 22 in FIG. 2. Such a thinned blade 16 increases the width of a gap 38 between a side wall 39 of the portion 22 and the adjacent ridge 23. The gap 38 of such increased width, however, permits the contact 14 to wedge between the ridge 23 and the blade 16. Increased frictional forces due to such wedging increase wear on both gold plated surfaces and also cause wear on the ridge 23. The wear on the ridge 23 adds an accelerating factor to the wear of the gold layers, since any removal of material from the ridge further increases the gap 38 to promote an even greater wedging action.

3. A Treating Apparatus and Process

FIG. 4 shows a sectional view of a treating apparatus designated generally by the numeral 41 which is useful in the practice of the invention in relationship to the blade 16. Treating the surface 18 with the features found in the apparatus 41 permits defects to be removed from the surface 18 without any appreciable thinning of the blade 16.

The apparatus 41 has a tank 42 of an inert plastic material of the type which is typically used in commercial plating or other electrolytic operations. The tank 42 includes a central treating cell 43 formed of at least a portion of a base 44 of the tank 42, side walls 46 and ends 47 and 48. At least an upper edge 51 of the end 47 has a predetermined height above the base 44 and functions as overflow or weir 51 for the cell 43. The weir 51 functions in determining the fluid level 49 in the cell 43.

Fluid flowing from the cell 43 is collected in a reservoir 53 located on at least the end 47 adjacent to the weir 51. However, the cell 43 may be located centrally within the tank 42 to be surrounded by the reservoir 53. Typical fluid ducts or pipes 54 are coupled to a pump 56. The pump 56 circulates the fluid by pumping it at a predetermined rate from the reservoir to the cell 43. The pumping rate can be matched to the fluid discharge from the weir 51 to establish the fluid level 49 as substantially constant in the cell 43.

An electrode 58 extends substantially the full length of the cell 43 at a predetermined spacing from the intended fluid level 49. The spacing between the electrode 58 and the fluid level 49 is preferably chosen to be substantially the same as the typical spacing between an electrolytic electrode and workpieces to be exposed to the electrolytic fluid. The electrode 58 is connected to one terminal of a conventional power supply 61. The other terminal of the power supply is coupled to the strip 31 of the blades 16. The strip 31 is suitably guided by lateral guides 62 and more importantly by vertical guides 63 which permit the strip 31 to span the length of the cell 43 at a predetermined height. While the guides 62 and 63 restrict the movement of the strip 31 in a plane perpendicular to its length, they permit the strip to advance in its longitudinal direction. As shown in FIG. 4, the strip 31 is oriented to expose the edge surfaces 18 of each blade 16 to the treating fluid.

The vertical position of the strip 31 is adjusted with respect to the fluid level of the treating fluid such that the edge surfaces 28 contact the surface of the fluid. The fluid wets the blades and the surface tension of the fluid wets and draws up on the side walls 39 of the blades 16, forming a meniscus 64 at the walls 39 as shown in FIG. 5. The amount of wetting, of course, may differ between various treating fluids, and is affected by changes in viscosity of any particular treating fluid. It has been found that the surface tension of a particular, active treating fluid offers sufficient adhesion of the fluid to the side walls 39 to maintain the edge surface 18 of the blade 16 exposed to and in contact with the fluid even though the blade may become positioned slightly above the surface of the fluid for brief periods while the strip 31 advances past the treating cell 43. Periods during which the surfaces 18 in the strip 31 become positioned slightly above the fluid level occur through slight changes in the fluid level or through deformed portions of the strip 31 which, at times, affect the vertical guiding of the strip.

The vertical guides 63 position the strip to place the surfaces 18 at an equal level with, or slightly above, the fluid level 49 in the cell 43. It has been found that the fluid in the meniscus 64 above the normal fluid level in the cell apparently becomes substantially stagnant with respect to the strip 31, i.e., the fluid in the meniscus appears to have little ionic dispersion into the bulk of the fluid.

FIG. 5 shows an enlarged end section of the cell 43 in relationship to one of the blades 16 of the strip 31. The burrs 36 and imperfections 37 of the surface 18 are efficiently removed in a continuous operation wherein the strip 31 moves at a predetermined speed past the cell 43. The electrode 58 is negatively charged by the power supply, and a conventional electrical connection charges the strip 31 positively or anodically with respect to the electrode 58 to initiate an electrolytic deburring operation. During such deburring action or treatment the surfaces 18 are fully exposed to the bulk of the fluid. Each surface 18 squarely faces the electrode 58. Hence, electrolytic deburring and smoothing of the surface 18 occurs rapidly.

The side walls 39, on the other hand, appear to be shielded from an electrolytic action of the extent in which it is experienced by the surface 18. While some electrolytic action may occur on the side walls 39 at the very onset of the treatment of the strip 31, the thinning of the blades is minimal and tolerable to the extent that it does occur.

The theory of electropolishing in relation to the above described method is not completely understood. However, it is theorized that after an initial electrolytic action in the meniscus, an electrolytic removal of metal from the side walls into the meniscus rapidly decreases. Such decrease is believed to be a result of the substantially stagnant fluid in the meniscus, which apparently retains an increased concentration of metal ions to become increasingly more resistive and inert. Such resulting ion-saturated and inert fluid in the meniscus is believed to produce an effective partial shield to the electrolytic action on the side walls 39 of the blade 16. It should be understood, however, that the invention is not predicated on any of the theory discussed herein. The above theory is merely offered as a possible explanation for some of the observed results and advantages of the subject matter herein. The discussed theory also should not be considered as in any way limiting the scope of the invention.

As discussed, the selectiveness of the treatment appears to be the result of the difference of activity between the fluid in the stagnant meniscus and in the bulk of the fluid. The surface 18 being exposed to the bulk of the fluid in which there is relatively free ionic movement appears to become more actively treated when there is more active movement of the fluid relative to the surface 18. This movement may, for instance, be enhanced by the movement of the strip 31 past the cell 43. Such movement causes at least some additional agitation in the fluid. The relative movement between the strip 31 and the fluid is not likely to adversely affect the protective qualities of the meniscus unless the fluid agitation increases to a point at which the tranquil conditions of the meniscus themselves become disturbed or destroyed.

As is indicated by an arrow 71, fluid flow in the cell 43 according to the preferred embodiment is in the same direction as the direction in which the strip 31 moves past the cell. However, it should be apparent from the above discussion on the advantages of the meniscus that a fluid flow in a direction opposite to that of the movement of the strip also lies within the scope of this invention as long as the side walls can be protected by the relatively stagnant conditions within the meniscus. Care should be taken, however, to guide the strip 31 vertically to retain the edge surface 18 substantially contiguous with the surface of the fluid. When the blade 18 just touches the fluid, the meniscus is believed to offer optimum shielding to minimize electrolytic action on the walls 39 of the blades 16 even in the presence of a movement of the fluid relative to the strip 31.

In the described preferred embodiment, the cell 43 has a length of approximately 15 cm. The strip 31 moves past the cell of a constant velocity of approximately 1.2 cm per second, thus exposing each of the blades to a deburring action for about 13 seconds. This time has been found to be sufficient to smooth the surface 18 in a bath consisting essentially of 62.1% by volume of 85% phosphoric acid, 2.6% by volume sulphuric acid and 35.3% by volume of deionized water. The preferred temperature range is normal room temperature up to approximately 37° C. The preferred current density applied under these conditions is in the order of 250 amps per $dm^2$ (square meter $\times 10^{-2}$).

It should be realized, however, that these stated conditions refer to a specific example and are not critical to the practice of the invention. For instance, the stagnant conditions in the meniscus exist even in the absence of an electrolytic potential. Thus, even in a purely chemical reaction bath, the sides of each blade 16 would tend to become shielded by the meniscus in comparison to the reaction on the surface 18, when the blade 16 is exposed to the bath in the manner shown in FIG. 5. It should, therefore, be realized from the foregoing description that various changes can be made as, for example, changes in the conditions of the bath or fluid and in the electrolytic plating conditions without departing from the spirit and scope of the invention.

In the further preparation of the blades 16, the preferred electro-deburring process described herein is followed by typical rinsing operations prior to plating. A preferred plating process includes plating a base nickel layer prior to plating a gold layer or soft and hard gold layers in a conventional manner. According to one theory, the nickel layer is considered to be a barrier layer to solid state diffusion of copper through the gold. Copper migrating through the gold to the contact surface may ultimately raise the electrical surface resistance at the surface 18. The barrier layer of nickel has been used in an effort to inhibit such diffusion.

It should be understood that treating operations using meniscus shielding as described herein are not limited to preparing a surface for gold plating. Frequently, surfaces require a high degree of smoothness but specifications do not call for a gold plated finish. Treating operation, in particular the example of the electro-deburring operation, is regarded as being useful wherever a smooth face or edge, such as the edge surface 18, is required on an article, and adjacent surfaces are desirably protected from the smoothing or polishing operation. It should be apparent that any number of changes and modifications are possible without departing from the spirit and scope of this invention.

What is claimed is:

1. A method of selectively treating an article to smooth an edge surface of such article in an electrolytic bath wherein surfaces of such article upon being exposed to a wetting treating fluid are acted upon by such fluid, the method comprising:

contacting an edge surface of the article to the surface of the wetting treating fluid such that the surface tension of the fluid causes a meniscus to form along surfaces adjacent to the edge surface;

vertically positioning the edge surface with respect to the surface of the treating fluid to maintain the edge surface substantially at the surface of the bath and to expose the side surfaces of the article to substantially none of the treating fluid other than that contained in the meniscus, thereby limiting the action of the treating fluid on such side surfaces; and removing the edge surface of the article from contact with the bath of the treating fluid after a time period sufficient to conclude the smoothing treatment by the fluid on the exposed edge surface of the article.

2. A method of selectively treating an article according to claim 1, wherein the fluid in negatively charged with respect to the article, and vertically positioning the edge surface of the article comprises:

vertically restraining the edge surface to maintain the edge surface in a position ranging from above the surface of the fluid to approximately the surface level of the fluid.

3. A method of selectively treating an article according to claim 2, which comprises:

moving the article relative to a treating cell in a direction parallel to the surface of said treating fluid located in the treating cell.

4. A method of selectively treating an article according to claim 3, which further comprises:

minimizing relative motion between the article and the fluid by moving the surface portion of the fluid in the cell in the same direction as that of the movement of the article relative to the cell.

5. A method of selectively treating a surface of an article according to claim 3, which comprises:

adjusting the speed of movement of the article relative to the cell whereby the time period sufficient to conclude the treatment of the article substantially equals the time period for the article to advance the length of the cell.

6. A method of selectively treating a surface of an article according to claim 5, wherein the article is one of a plurality of articles interconnected into a strip and the strip of articles is moved longitudinally along the surface of the fluid in the cell.

7. A method of selectively treating a surface of an article in accordance with claim 6, which comprises circulating the fluid in the cell between the cell and a reservoir, such circulating including pumping the fluid from the reservoir to the cell and overflowing the fluid from the cell across a weir to agitate the fluid and establish a substantially constant surface level of the fluid.

8. A method of selectively treating a surface of an article in accordance with claim 7, wherein the fluid is pumped to an end of the cell, said end being located opposite from the weir, and the strip of articles is moved along the length of the cell from said end toward the weir, whereby the flow of the fluid within the cell follows the direction of motion of the strip.

9. A method of selectively treating a surface of an article according to claim 8, which comprises:

regulating the fluid flow through the pump to control the fluid level in the cell.

* * * * *